US010433595B2

(12) United States Patent
Bell

(10) Patent No.: US 10,433,595 B2
(45) Date of Patent: Oct. 8, 2019

(54) GARMENT CONFIGURED FOR PROTECTING WEARER'S LEGS

(71) Applicant: Badger Built, LLC, Florissant, CO (US)

(72) Inventor: Jason Eric Bell, Florissant, CO (US)

(73) Assignee: BADGER BUILT, LLC, Florissant, CO (US)

( * ) Notice: Subject to any disclaimer, the term of this patent is extended or adjusted under 35 U.S.C. 154(b) by 367 days.

(21) Appl. No.: 15/397,542

(22) Filed: Jan. 3, 2017

(65) Prior Publication Data

US 2017/0188641 A1 Jul. 6, 2017

Related U.S. Application Data

(60) Provisional application No. 62/387,660, filed on Dec. 31, 2015.

(51) Int. Cl.
*A41D 13/05* (2006.01)
*A41F 9/02* (2006.01)

(52) U.S. Cl.
CPC ..... *A41D 13/0543* (2013.01); *A41D 13/0568* (2013.01); *A41F 9/025* (2013.01); *A41D 2600/102* (2013.01); *A41D 2600/202* (2013.01)

(58) Field of Classification Search
CPC ..... A41D 13/0543; A41D 13/0568; A41D 2600/102; A41F 9/025
See application file for complete search history.

(56) References Cited

U.S. PATENT DOCUMENTS 1,788,195 A * 1/1931 Iskin ..... A41D 1/086 2/227
2,483,136 A * 9/1949 Hamman ..... A41D 3/06 2/82
3,526,221 A * 9/1970 Garber ..... A41D 13/0506 128/889
4,459,979 A 7/1984 Lewis, Jr.
4,506,391 A * 3/1985 Rodman ..... A41D 1/086 2/227
5,334,134 A 8/1994 Saunders
6,099,490 A * 8/2000 Turtzo ..... A61F 5/028 2/311
6,165,147 A * 12/2000 Morrow ..... A61F 5/028 602/13

(Continued)

FOREIGN PATENT DOCUMENTS

FR 2949298 A1 3/2011

OTHER PUBLICATIONS

Silverback Chaps, www.silverbackchaps.com, Silverback Chaps Ltd., North Yorkshire, England.

*Primary Examiner* — Richale L Quinn
(74) *Attorney, Agent, or Firm* — Marsh Fischmann & Breyfogle LLP; Russell T. Manning

(57) ABSTRACT

A garment related to leg protection for hazardous activities. Darts and pleats sewn or otherwise constructed into such a garment to improve fit and contouring. The garment may comprise a belt assembly providing improved comfort and reduced fatigue and injury with pivot points adjacent a wearer's hips. The belt assembly may have a shape to mimic that of a human pelvis. Such a shape may facilitate the transfer of weight more directly onto the wearer's bone structure with less strain on the wearer's muscles.

16 Claims, 7 Drawing Sheets

(56) References Cited

U.S. PATENT DOCUMENTS 6,202,215 B1 * 3/2001 Sauter ..... A41D 13/0012 2/51
6,338,164 B1 * 1/2002 Howard ..... A41D 13/015 2/23
6,519,775 B1 * 2/2003 Garcia ..... A41D 13/0506 2/22
6,665,875 B1 * 12/2003 Alonso ..... A41D 13/04 2/46
6,839,917 B1 * 1/2005 Landwehr ..... A41D 13/04 2/22
D501,583 S * 2/2005 Taylor ..... D2/639
7,165,706 B2 * 1/2007 Barr ..... A45C 7/009 224/661
7,350,240 B2 * 4/2008 LaGrone ..... A41D 13/04 2/2.5
8,393,016 B2 * 3/2013 Wilkins-Gaudio ..... A41F 9/002 2/312
2002/0020000 A1 * 2/2002 Garcia ..... A41D 13/0506 2/23
2003/0052144 A1 * 3/2003 Vardi ..... A45F 3/14 224/258
2004/0245305 A1 * 12/2004 Garcia ..... A45F 5/00 224/661
2006/0150293 A1 * 7/2006 Toso ..... A41D 13/0007 2/22
2007/0245469 A1 * 10/2007 Young ..... A41D 13/0543 2/458
2008/0190980 A1 * 8/2008 Overton ..... A45F 3/14 224/664
2009/0031466 A1 * 2/2009 Grimes ..... A41B 13/00 2/22
2009/0070910 A1 * 3/2009 McNally ..... A41D 13/04 2/23
2010/0152636 A1 * 6/2010 Parks ..... A61F 5/028 602/19
2011/0072545 A1 * 3/2011 Bennett ..... A41D 13/0543 2/2.5
2013/0091614 A1 * 4/2013 Teets ..... A41D 13/04 2/51
2013/0191956 A1 * 8/2013 Elliott ..... A41D 13/04 2/46
2014/0230116 A1 * 8/2014 Weber ..... A41D 13/0568 2/22
2015/0282535 A1 * 10/2015 Rowe ..... A41D 1/067 2/237

* cited by examiner

GARMENT CONFIGURED FOR PROTECTING WEARER'S LEGS

RELATED APPLICATIONS

This application claims the benefit of U.S. Provisional Patent Application No. 62/387,660 filed Dec. 31, 2015, entitled "APRON NORMALLY WORN BY FARRIERS," which is incorporated herein by reference in its entirety.

FIELD

This disclosure relates to the field of aprons, pants, chaps, and other garments configured to protect the legs of an individual wearing the garment.

BACKGROUND

Individuals frequently participate in activities which may cause injury or discomfort to certain extremities, particularly their legs. For example, operating power tools or machinery, such as a chainsaw, may leave a person's legs susceptible to injury from the chainsaw itself or projectiles and debris. In another example, a person riding a motorcycle may be susceptible to leg injury due to collision with another vehicle or an obstacle such as a bollard or traffic control device (e.g., cone, barrel, delineator, etc.). In the event of a fall, a rider may even need protection from the surface of the road. As a further example, a farrier may be exposed to leg injury when installing a shoe on a horse's hoof. For example, a horse may flinch or kick causing the hoof or a protruding nail to impact the farrier's leg. In each of these scenarios, embodiments of the present disclosure may serve to protect the wearer's legs.

Prior art garments have been provided for covering at least a portion of a person's legs to prevent injury, but often these prior art garments have drawbacks. Certain ones may constrict the wearer's waist, restricting range of motion of the pelvis and hips causing pain and discomfort during extended use, particularly in a sitting or squatting position. This problem may be exacerbated by clothing or accessories worn under the garment such as leather belts, metal belt buckles, or other firm materials near the wearer's waist. In situations of extended or repetitive use, chronic pain may result. There remains a need for a protective garment with an ergonomic design in the pelvic region to reduce the instances of fatigue, pain, and discomfort.

Similarly, many existing garments have a relatively rigid belt which fails to flex or pivot in a manner which appropriately mimics or tracks the flexing of a person's hips. These belts are often of one piece construction or otherwise fastened together and are constructed of materials (e.g., leather) which don't easily bend in the orthogonal direction given the usual width of the belt (e.g., about one to three inches). Therefore, when a wearer bends at the waist, the belt remains substantially rigid and may cause discomfort where the belt exerts pressure on the wearer's abdomen or thighs. Such a belt may also restrict the wearer's movement.

Other existing garments may have protective portions which tend to flex away from a wearer's leg. This may both expose the wearer's leg to injury and physically interfere with work being performed. For example, a farrier often positions a horse's leg between his or her thighs or knees while preparing the hoof and installing a shoe. Loose protective garments such as prior art farrier aprons often tend to flare away from the farrier's shin while squatting given the rigidity of the materials used and the manner in which such aprons are secured to the legs. Such flaring not only may physically and visually interfere with the work being performed, but can also expose portions of the wearer's legs, such as the calf and shin. This condition may also be dangerous in the event that the horse's hoof becomes entangled in the protruding garment.

In the event that a garment becomes entangled with a hazard, it may cause injury to the wearer. For instance, a horse's hoof, in the context of a farrier's apron, or a power tool or piece of machinery, in the context of protective chaps, may become ensnared with such garments. As a garment is twisted, tugged, pulled, or otherwise manipulated it may cause lacerations, fractures, bruising, dismemberment, etc.

Therefore, a need exists for a garment configured to shield or protect at least a portion of a wearer's legs which is designed to: fit ergonomically around the hips; flex or pivot as the wearer moves; remain snug around the wearer's legs while squatting or kneeling; and/or prevent hazardous entanglement.

SUMMARY

The present disclosure relates generally to garments configured to protect a wearer's legs. Although the terms "farrier's apron," "farrier apron," "apron," etc. are used throughout this disclosure, it is contemplated that such terms may refer generally to pants, aprons, leggings, chaps, or any other garment configured in a manner which shields or protects a portion of a wearer's legs or which suspends an amount of weight from a wearer's waist area. Such garments may be intended for any purpose or application including, but not limited to, riding a horse or motorcycle, operating power tools or machinery, shoeing horses, welding, blacksmithing, construction or even common clothing items (e.g., jeans, khakis, etc). It is contemplated that certain aspects of the present disclosure may be applicable to belts from which objects are supported (e.g., tool belt, climbing harness), even in the absence of protective leg members.

Although the terms "wearer," "farrier," "person," and "user" may be used throughout this disclosure, those terms are interchangeable and may generally refer to any person making or wearing a garment comprising any of the features, aspects, or embodiments disclosed herein. Such a person may be a blacksmith, a farrier, a mechanic, a lumberjack, man, woman, child, or any other person.

The disclosed embodiments provide a number of benefits over the prior art. For instance, a belt assembly is disclosed which provides a more comfortable fit and improved flexibility. Additionally, inclusion and placement of darts and pleats forms a more contoured design, which reduces interference with a wearer's activities. Moreover, such contoured shape may allow the garment to contact the wearer's legs over a greater area, thereby transferring a portion of the weight of the garment to the wearer's legs and reducing the force exerted at the belt line. Furthermore, safety features of the disclosed embodiments allow for expedited removal of the garment.

Accordingly, a first embodiment of a garment includes a belt assembly having a front belt member, a rear belt member, and a first belt link. The front belt member includes a top edge, a bottom edge, a first side portion, a second side portion, and a central portion disposed between the first and second side portions. The first and second side portions are each disposed at an upward angle with respect to the central portion in a direction of the top edge. The first belt link is operable to pivotally attach the front belt member to the rear belt member. The garment further includes at least a first leg member extending from the bottom edge of the front belt member and bounded by the front belt member at a proximal edge of the leg member, an inner edge extending from the central portion, an outer edge extending from the first side portion, and a distal edge connecting the inner edge and outer edge at a distal end of the leg member.

In one aspect, the central portion of the front belt member is substantially linear and has a length of at least about 5 inches.

In another aspect, the first belt link is a loop with a width exceeding a width of either the front belt member or rear belt member at an end of the front or rear belt member that is attachable to the first belt link. The front belt member and rear belt member may be slidably affixable to the loop such that the rear belt member is pivotally attachable to the front belt member.

In one embodiment, the first and second side portions may each form an angle of at least about 10 degrees with respect to central portion.

In an embodiment, a portion of the front belt member may be integrally formed with the first leg member.

In another aspect, the belt assembly may include a second belt link operable to pivotally attach the front belt member to the rear belt member. The belt assembly may also include at least two elastic members for securing the rear belt member to the front belt member via the first and second belt links.

In yet another aspect, the belt assembly may include a first tensioning strap extending from the first side portion. The first tensioning strap may be removably attachable to the first side portion to pass through the first belt link and secure the front belt member to the first belt link. The first tensioning strap may removably attachable to the first side portion via a hook and loop fastener secured to the first side portion and a corresponding hook and loop fastener secured to the first tensioning strap. Further, the belt assembly may include a second tensioning strap extending from the second side portion. The second tensioning strap may also be removably attachable to the second side portion to pass through the second belt link and secure the front belt member to the second belt link. The second tensioning strap may removably attachable to the second side portion via a hook and loop fastener secured to the second side portion and corresponding hook and loop fastener secured to the second tensioning strap.

In another embodiment, the garment may include a first leg strap link disposed at the inner edge, a second leg strap link disposed at the outer edge and nearer the proximal end than the first leg strap link, and a leg strap operable to attach to both the first and second leg strap links. At least one of the first or second leg strap links may be removably attachable to the leg member via a safety release. The safety release may be a snap fastener.

In another aspect, a leg member may be comprised of nylon. An overlay material may be disposed on, within, or attached to the base material. An overlay material may, for instance, be leather and may be disposed on a front side of the garment. An overlay material may cover any portion of the front side of the garment, for instance, at least 50% of the front side of the leg member.

In another aspect, a garment may include a second leg member extending from the bottom edge of the front belt member and bounded by the front belt member at a proximal edge of the second leg member, an inner edge of the second leg member extending from the central portion of the front belt member, an outer edge extending from the second side portion of the front belt member, and a distal edge connecting the inner edge of the second leg member and outer edge of the second leg member at a distal end of the second leg member. The inner and outer edges of each of the first and second leg members may be spaced apart from the other.

In another embodiment, a garment may include: a belt assembly configured to support the garment around the waist of the user; a leg member extending from a bottom edge of the belt assembly and bounded by the belt assembly at a proximal end, and comprising an outer edge extending substantially perpendicular from the bottom edge, an inner edge extending from the bottom edge and tapering away from the outer edge such that a width of the leg member adjacent the proximal end is less than a width of the leg member near a distal end, and a distal edge connecting the inner and outer edges at the distal end; and a dart sewn into the leg member adjacent the inner edge. A dart may have any suitable length. For example, a dart may have a length of at least 2 inches and less than 12 inches. A dart may sewn into a base material of the leg member, an overlay material sewn onto or into the base material, or both.

In another aspect, a pleat may extend from the outer edge in a direction toward the inner edge.

In another embodiment, a belt assembly may include a front belt member having a top edge, a bottom edge, a first side portion, a second side portion, and a central portion disposed between the first and second side portions. The first and second side portions may each be disposed at an upward angle with respect to the central portion in a direction of the top edge. The belt assembly may also include a rear belt member and at least one belt link operable to pivotally attach the front belt member to the rear belt member. In one example, at least two belt links may be included.

DETAILED DESCRIPTION

Figure 1:
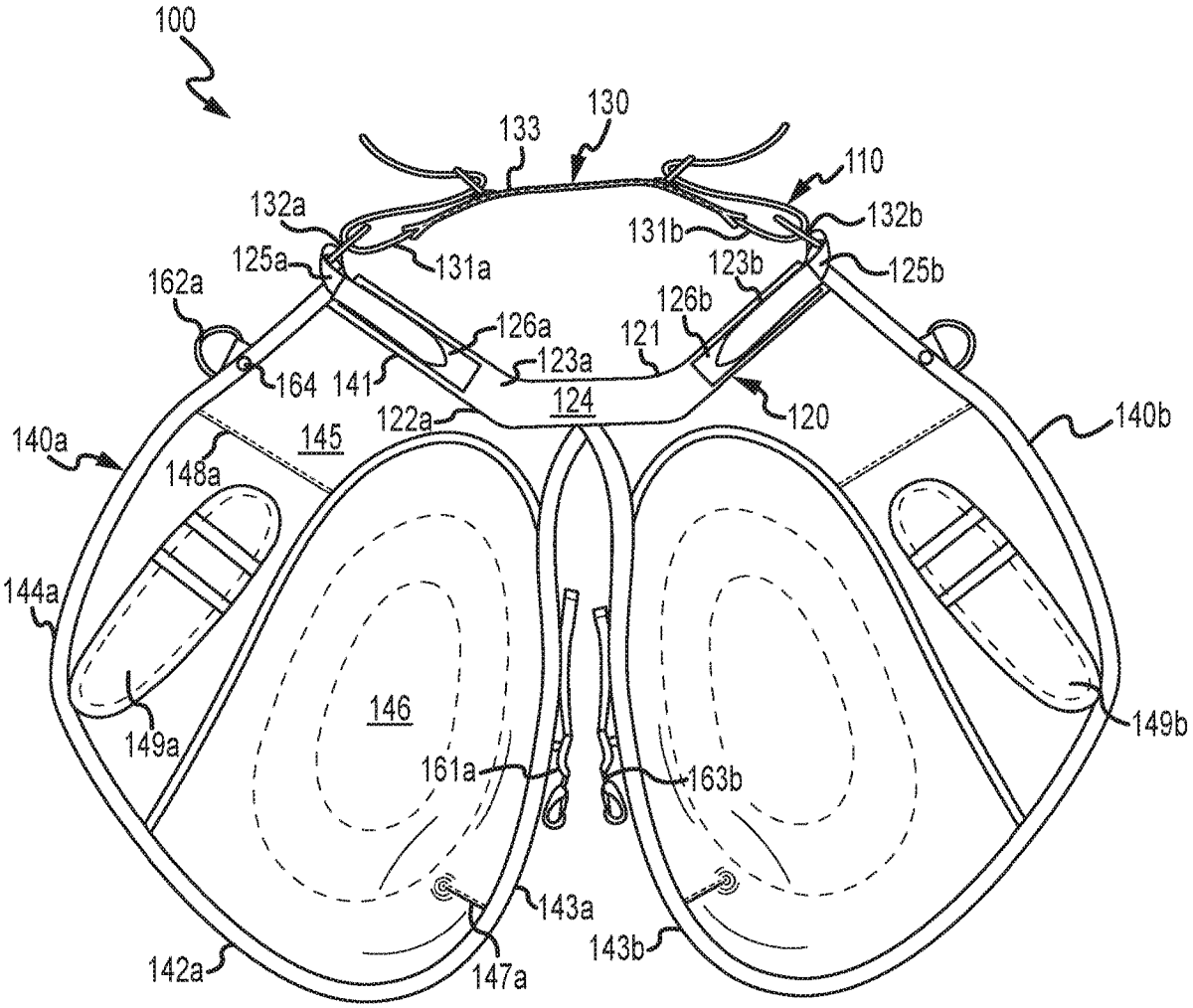
FIG. 1 illustrates a front view of a farrier's apron according to an embodiment.
Figure 2:
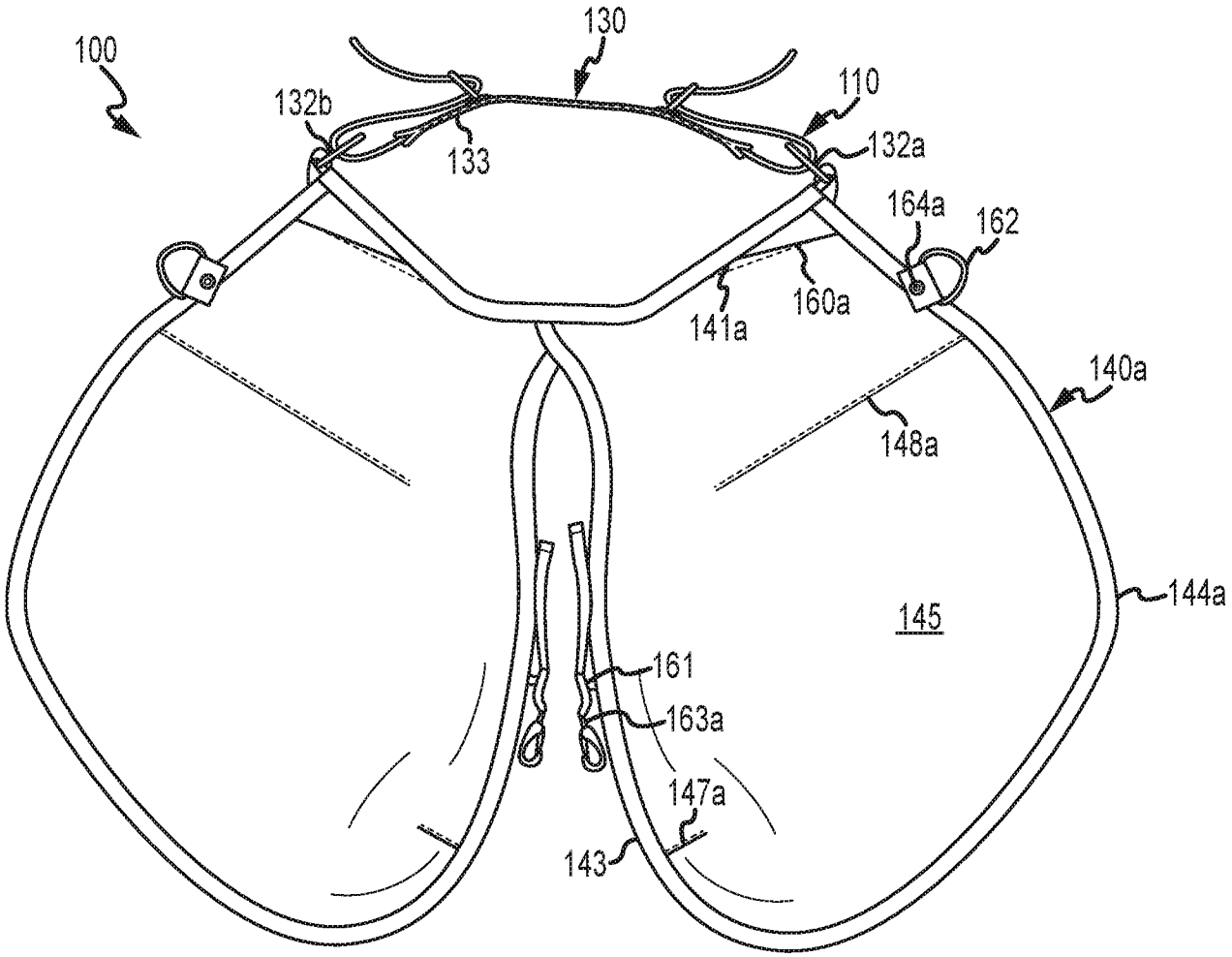
FIG. 2 illustrates a rear view of a farrier's apron according to an embodiment.

Referring to FIGS. 1 and 2, a garment 100 is illustrated, with FIG. 1 illustrating a front view and FIG. 2 illustrating a rear view. The garment 100 generally includes a belt assembly 110 and at least one leg member (e.g., leg member 140*a*). The garment 100 may be worn over a wearer's pants or may be worn independently. The belt assembly 110 includes a front belt member 120 having a top edge 121 and a bottom edge 122. The front belt member 120 is generally comprised of a first side portion 123*a* and a second side portion 123*b* with a central portion 124 disposed between the two side portions 123*a*/123*b*. The central portion 124 may be substantially linear (e.g., in the form of an elongated rectangle) with regard to the overall shape. The two side portions 123*a*/123*b* are each disposed at an upward angle with respect to the central portion 124 in a direction of the top edge 121. This design may provide an ergonomic and comfortable fit wherein the belt assembly 110 is configured such that the central portion 124 is disposed below the wearer's waist and/or belt (see FIG. 4). The front belt member 120 may be an independent member which is removably attachable (e.g., a traditional belt through belt loops), an independent member which is permanently attached to the garment 100 (e.g., sewn to leg members 140*a*/140*b*, as shown), or may be an integral part of the garment 100 (e.g., not an independent member but rather defined as an upper portion of leg members 140*a*/140*b*).

The front belt member 120 may further comprise at least one tensioning strap (e.g., tensioning strap 125*b*) which is removably attachable to a side portion (e.g., side portion 123*b*) via a hook and loop fastener (e.g., hook and loop fastener 126*b*), for example, on one end (i.e., free end) and is permanently attached to the leg member 140*b* on the other end. Permanent attachment of the tensioning strap, or any other component of the present disclosure, may be achieved by sewing, riveting, applying an adhesive, or any other appropriate method. Further, the tensioning strap 125*b* may be integrally formed with the corresponding side portion. The tensioning strap 125*b* may be attached to the front belt member 120, as shown, or may be attached to a leg member 140*b*, a rear belt member 130, an elastic member 131*b*, or any other component in a manner which enables a wearer to pull on the tensioning strap 125*b* to alter the size of the opening created by the belt assembly 110. The tensioning strap 125*b* may be constructed of either an elastic or inelastic material, preferably a durable material capable of withstanding repetitive pulling, flexing, and tension. The free end of the tensioning strap 125*b* may be passed through a belt link 132*b* and may be a removably attachable component of the garment 100. In this manner, the wearer may quickly and easily release the tensioning strap 125*b* by pulling apart the corresponding hook and loop fasteners (or any other appropriate fastening mechanism) to remove the garment 100. This may be necessary, for example, if a horse's leg becomes tangled with the leg member 140*b* (e.g., tangled with a leg strap 163*b*) such that the wearer may avoid injury.

The belt assembly 110 also includes a rear belt member 130 which may have at least one elastic member 131*b*. The elastic member 131*b* may facilitate a flexible fit of the belt assembly 110 on the wearer. The rear belt member 130 may be constructed from leather, Cordura®, cotton, canvas, Kevlar®, rubber or any other suitable material. It may be constructed from one material or may comprise multiple materials. For example, a base portion 133 of the rear belt member 130 may be leather while an elastic member 131*b* may be constructed from a different material and attached to the leather base portion 133. The front belt member 120 and the rear belt member 130 may be connected via at least one belt link, such as belt link 132*b*. It should be appreciated that although an elastic member such as elastic member 131*b* may often be constructed of an elastic material to provide flexible elongation of the belt assembly 110, it is also contemplated that such an elastic member 131*b* may be constructed of an inelastic material to provide a rigid connection of a base portion 133 to a belt link, such as belt link 132*b*. It is also contemplated that a belt assembly 110 may have one elastic member or no elastic member.

Preferably, two belt links 132*a*/132*b* may be used to connect the rear belt member 130 to the front belt member 120, one on either side of the wearer. In this regard, a first tensioning strap 125*a* of the front belt member 120 may be connected to a forward portion of belt link 132*a* and another tensioning strap 125*b*, opposite the first, may be connected to a forward portion of another belt link 132*b*. A first elastic member 131*a* of the rear belt member 130 may be connected to the rear portion of one belt link 132*a*, while the other elastic member 131*b* may be connected to the other belt link 132*b*. In this regard, a loop is formed by a chain comprising one end of the front belt member 120, a belt link 132*a*, the rear belt member 130, and another belt link 132*b* which may, in turn, be connected to the other end of the front belt member 120. Preferably, each belt link 132*a*/132*b* may be disposed at a position on the wearer's hip approximately corresponding to the axis on which the wearer bends, one belt link 132*a* on the wearer's right side and the other belt link 132*b* on the wearer's left side. In this arrangement, the front belt member 120 (e.g., via the tensioning straps 125*a*/125*b*) and/or the rear belt member 130 (e.g., via elastic members 131*a*/131*b*) may pivot about the belt links 132*a*/132*b* as the wearer bends at the waist, forward and backward, to mimic the movement of the wearer's pelvis. Such movement may improve comfort and decrease fatigue and pain for the wearer. The pivoting of the belt members 120,130 about the belt links 132*a*/132*b* may be facilitated by attaching each respective end of the belt members 120, 130 to the belt links 132*a*/132*b* in a loose (e.g. unfettered) manner. That is to say, a portion of a belt member 120, 130 (e.g., a tensioning strap 125) may be passed through a belt link 132, and then doubled back and secured onto the remainder of the belt member 120, 130 such as through hook and loop fasteners. The combination of the two belt links 132*a*/132*b* disposed opposite one another on the wearer's hips allows the front belt member 120 to move in a hinged fashion (e.g., pivotable) relative to the rear belt member 130. Notably, if one or both belt links 132*a*/132*b* is not positioned in a desired location of the wearer's hips, the wearer may adjust the positioning of the elastic members 131 and tensioning straps 125, allowing the belt links 132*a*/132*b* to be moved forward or backward relative to the wearer. That is to say, tightening a tensioning strap 125 (i.e., pulling forward and securing the free end to a position nearer the center of the garment) and loosening (i.e., extending) an elastic member 131 of the rear belt member 130 may move a belt link 132 forward. Similarly, loosening a tensioning strap 125 and tightening (i.e., shortening) an elastic member 131 of the rear belt member 130 may move a belt link 132 rearward.

A belt link 132 may be any device capable of attaching to the front belt member 120 and rear belt member 130 in a manner that permits independent movement of the belt members 120, 130 as the user bends at the waist. For example, a ring or loop may be used. Preferably, a loop may be of a diameter or width exceeding that of the belt members 120, 130 to facilitate sliding movement of the belt members 120, 130 along the inside of the loop. Such a loop may be constructed of any metal, wood, plastic, carbon fiber, or any other material which facilitates the properties or functionality described herein. Although described as a ring or loop, a belt link 132 may be any shape, for instance, a circle, an oval, a square, a "D", etc. Alternatively, a belt link 132 may be a hinge. In this regard, a belt link 132 itself may hinge or pivot to provide the pivoting motion desired between the front belt member 120 and rear belt member 130, as described in more detail below. For example, a flexible "V" shaped member may be used as a belt link 132, wherein the two extensions are spaced apart when the wearer stands upright but move nearer to one another as the wearer bends forward. Similarly, an inverted "V" shaped member may be used such that the two extensions are nearly parallel when the wearer stands upright but spread further apart as the wearer bends forward.

Each leg member 140*a*/140*b* is generally bounded by a proximal edge (e.g., proximal edge 141*a*) adjacent the front belt member 120, a distal edge (e.g., distal edge 142*a*), an inner edge (e.g., inner edge 143*a*), and an outer edge (e.g., outer edge 144*a*). The proximal edge of a leg member is typically defined by the bottom edge 122 of the belt assembly 110. However, a portion of a leg member may extend over or under, or be an integral part of the front belt member 120. An inner edge may extend downwardly from the central portion 124 of the front belt member 120. When the garment 100 comprises two leg members, e.g., leg members 140*a*/140*b*, the inner edges 143*a*/143*b* may overlap one another, as shown, e.g., may each extend downwardly from roughly a single point, or the inner edge 143*a* of the right leg member 140*a* may extend downwardly from a point further left than a point from which the inner edge 143*b* of the left leg member 140*b* extends). In an embodiment, the inner edge 143*a* of the right leg member 140*a* may intersect the belt assembly 110 at the left side portion 123*b* and the inner edge 143*b* of a left leg member 140*b* may intersect the belt assembly 110 at the right side portion 123*a*. In this regard, there may be a substantial overlap of the two leg members 140*a*/140*b*. It is also contemplated that an inner edge 143 may extend downwardly from its respective side portion 123. For example, the inner edge 143*a* of the right leg member 140*a* may extend from the right side portion 123*a*. Alternatively, two adjacent leg members may be constructed from a single sheet of material. In this regard, the two leg members may share a single inner edge which does not intersect the belt assembly. In an embodiment, an outer edge (e.g., outer edge 144*a* of a leg member 140*a*) may extend from the bottom edge 122 of the front belt member 120 at a side portion 123*a*/123*b* of the front belt member 120. Generally, an outer edge may be substantially perpendicular to a bottom edge at the point of intersection. A distal edge connects an inner edge to an outer edge at a distal end of a leg member which is opposite a belt assembly.

Frequently, in the context of a farrier's apron, an inner edge and an outer edge of a leg member will diverge from one another moving from a proximal edge toward a distal edge, e.g., the leg members may be flared outward nearer a distal edge. In this regard, a leg member may be narrower adjacent a belt assembly than it is near a distal edge, as shown in FIGS. 1 and 2. However, it is contemplated that in the context of a pair of pants, for example, a leg member may be the same width or wider adjacent a belt assembly than near a distal edge, similar to a common pair of pants which may generally mimic the contour of a person's body. Notably, as mentioned above, certain features of the present disclosure (e.g., belt assembly 110 or dart 147 in FIG. 1) may be incorporated into otherwise common pants. In this regard, a leg member of a garment of the present disclosure may not include a distinct inner edge or outer edge. Rather, an inner edge may be sewn or otherwise connected to an outer edge to form a tubular leg member. Alternatively, a garment may comprise four leg members; two adjacent to a front belt member and two adjacent to rear belt member such that corresponding inner edges may be sewn together (or otherwise connected) and corresponding outer edges may be sewn together (or otherwise connected) to form two tubular members through which a wearer's legs may be disposed.

Referring again to FIGS. 1 and 2, the leg members 140*a*/140*b* may be made out of (e.g., cut or woven from) a base material 145 alone or may further comprise an overlay material 146. The base material 145 may be a relatively thin, flexible, or lightweight material that promotes comfort and flexibility (e.g., a nylon-based material, such as Cordura®). The overlay material 146 may be a relatively thick, durable, or heavy material which provides a degree of padding and is not easy torn or otherwise worn out (e.g., leather). It is contemplated that any suitable material may be used for either the base material 145 or the overlay material 146, or both. Materials may be substituted depending on the personal preferences of certain farriers or other wearers. For example, a blacksmith may prefer a garment with leather used for both the base material and the overlay material despite the substantial weight because it may offer a high degree of protection from heated forging tools. Conversely, a horse rider may prefer a garment with denim, for example, used for the base material with no overlay material at all in order to provide a lightweight garment even though it may only offer minimal protection in the event of a fall. It should be appreciated that an overlay material will generally provide a greater degree of protection from sharp objects, heat, or impact than will a base material, but not always. An overlay material may be layered on top of or under the base material to provide two layers of protection. Alternatively, an overlay material may be substituted for a base material in certain regions of a garment in which different characteristics are desired. In this regard, a base material may be shaped to have an edge which matches a corresponding shaped edge of an overlay material such that the two materials may be sewn together (or otherwise bonded) at their edge without a substantial amount of overlap or gaps.

In the embodiment illustrated in FIGS. 1 and 2, a dart 147*a* is sewn into the leg member 140*a* along the inner edge 143*a* to create a conical break in the base material 145 and/or overlay material 146. This feature is discussed in more detail below in reference to FIG. 6. A pleat 148*a* (FIG. 2) may be sewn into the leg member 140*a* to promote a conforming fit to the wearer's body. That is to say, curves and/or contours may be created in the leg member 140*a* (rather than being entirely flat) such that the garment 100 takes on a shape which generally complements the shape of the wearer. Although pleat 148*a* is shown extending inwardly from the outer edge 144*a* of the leg member 140*a*, it should be appreciated that a pleat 148*a* may be formed at any position on the leg member 140*a*. Additionally, multiple pleats may be desired to enhance the comfort and fit of the garment 100. For example, FIG. 2 illustrates a dart 147*a* along the inner edge 143*a*, a pleat 148*a* along the outer edge 144*a*, and a pleat 160*a* adjacent the intersection of the outer edge 144*a* and proximal edge 141*a*. Pleat 148*a* may aid in positioning the pocket 149*a* adjacent the outside of the wearer's leg where it is less likely to cause interference than if it were positioned adjacent the front of the wearer's leg (e.g., without pleat 148*a*). Pleat 160*a* may lift the outer edge 144*a* upward and rearward to retain the outer edge 144 of the leg member 140*a* nearer the wearer's leg than it would be without the pleat 160*a*. In this regard, the pleat 160*a* aids in maintaining the proper curvature of the leg member 140*a*.

A pleat (e.g, pleat 148*a*) may be formed in a similar manner as a dart (e.g., dart 147*a*). That is to say, the material (base material, overlay material, or both) may be cut and removed or folded in an overlapping manner and then sewn or otherwise bonded together. Generally, although not always, a pleat may be longer than a dart and may be formed by removing or overlapping a shorter length of material as measured at the adjacent edge from which the feature (e.g., pleat 148*a* or dart 147*a*) extends. That is to say, a pleat or dart is usually widest at the adjacent edge (e.g., inner edge 143*a*) and a dart is generally wider than a pleat, although not always. Any combination of pleats and darts in any region or edge of a leg member may be used, or in some instances, none at all. Pleats and darts may be oriented at any angle within the material including but not limited to vertically or horizontally.

Figure 5:
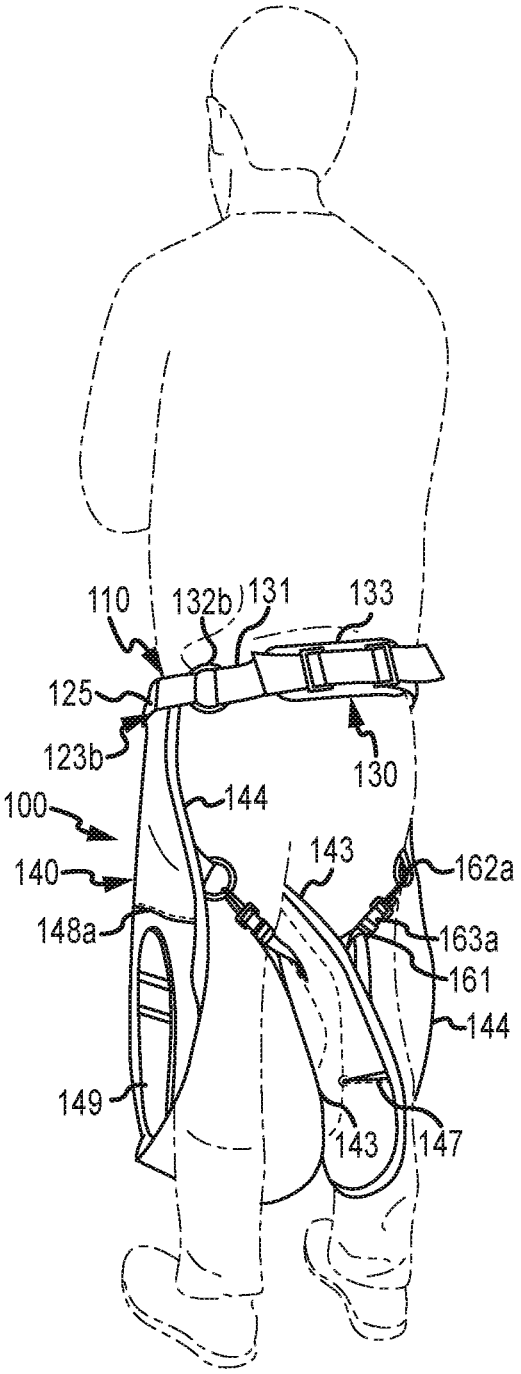
FIG. 5 illustrates a rear view of a wearer donning a farrier's apron according to an embodiment of the present disclosure.

A restraint mechanism may be incorporated into the leg members to conform the leg members to the wearer's body. Referring to FIGS. 1 and 2, a first leg strap link 161*a* may generally be disposed along the inner edge 143*a* of the leg member 140*a* and a second leg strap link 162*a* may generally be disposed along the outer edge 144*a* of the leg member 140*a*. Preferably, the distance between the second leg strap link 162*a* and the belt assembly 110 is less than the distance between the first leg strap link 161*a* and the belt assembly 110. In this regard, a leg strap 163*a* (FIG. 2) connected between the first leg strap link 161*a* and the second leg strap link 162*a* may cross behind a wearer's leg from a point near the wearer's knee on the inside of the wearer's leg upwardly to a point near the wearer's hip on the outside of the wearer's leg (as shown in FIG. 5). This positioning of the leg strap 163*a* may provide improved freedom of movement of the leg as well as increased comfort (e.g., may distribute force over a greater area of the leg than if leg strap 163*a* were horizontal), while also promoting safety. In this regard, the second leg strap link 162*a* may be attachable to the leg member 140*a* via a safety release 164*a*. If the leg member 140*a* or the leg strap 163*a* becomes entangled (e.g., in a piece of equipment or on an animal's leg), the safety release 164*a* may disengage at a threshold amount of force, thereby releasing the leg strap 163*a* from the leg member 140*a*. Preferably, by placing the second leg strap link 162*a* relatively near the belt assembly 110, and incorporating a safety release 164*a* between the second leg strap link 162*a* and the leg member 140*a*, the wearer may also be able to manually disconnect the leg strap 163*a* quickly should the need arise. This is, in part, due to the placement of the safety release 164*a* within the reach of the wearer's hand, even while the wearer is standing upright. In this regard, the wearer may be able to grab ahold of the safety release 164*a*, the second leg strap link 162*a*, or the leg strap 163*a* and apply a magnitude of force exceeding the threshold amount of force required to disengage the safety release 164*a*. A safety release may be disposed between a first leg strap link and a leg member, a second leg strap link and a leg member, or both. A safety release may also be incorporated into a leg strap itself.

The safety release 164*a* may be any appropriate device which facilitates the functionality described herein. Specifically, the safety release 164*a* should remain engaged (i.e., holding the leg strap in position behind the wearer's leg) during normal conditions (e.g., walking, kneeling, squatting, etc.) but the safety release 164*a* should disengage at a threshold amount of force which is preferably less than an amount of force which would cause injury to the wearer or to the garment 100. For example, the safety release 164*a* may be configured to disengage at an amount of force which is applied when a horse's leg becomes entangled in a portion of the garment 100 (e.g., leg member 140*a*, leg strap 163*a*). In the illustrated embodiment, the safety release 164*a* is a snap fastener disposed between the second leg strap link 162*a* and the leg member 140*a*, as discussed in more detail below.

As illustrated in FIG. 1, the garment 100 may further comprise at least one pocket 149*a*. A pocket may be disposed on the inside (e.g., rear side) of a leg member with an aperture providing access into the pocket from the front side, or a pocket 149*a* may be disposed on the front side of the garment, as shown. Preferably, the pocket 149*a* is fully disposed on the outer surface of the leg member 140*a*, as is illustrated in FIGS. 1 and 2. The pocket 149*a* may comprise a single receptacle or may comprise a plurality of receptacles. For example, the embodiment shown comprises two receptacles. The receptacles of a pocket may be sized to house at least a portion of a tool (e.g., a hammer, pliers, etc.), or any other item which may be needed, when not in use. In this regard, at least one tool may be stored on or in the garment 100 for ease of access (e.g., within reach) when needed. A pocket may be constructed from the base material, the overlay material, or any other suitable material to provide the flexibility, rigidity, durability, or other characteristics desired. As illustrated, the garment 100 includes a pocket 149*a*/149*b* on each of the leg members 140*a*/140*b*.

Figure 3:
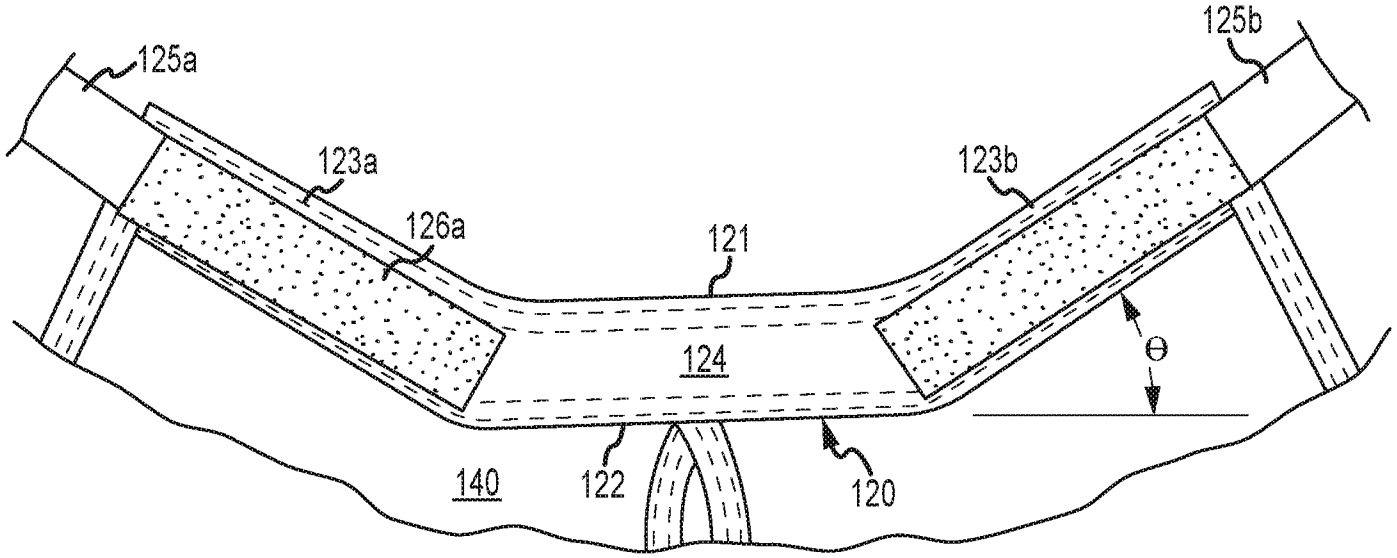
FIG. 3 illustrates a front view of an embodiment of a front belt member of a farrier's apron.

FIG. 3 illustrates a close-up front view of the front belt member 120. As shown, a central portion 124 is disposed between a first side portion 123*a* and a second side portion 123*b*. Notably, the side portions 123*a*/123*b* may generally be symmetrical (e.g., mirror image of one another) and there may be no significant difference between them. Although labelled 123*a* and 123*b*, either one may generally be referred to as the first or second side portion 123*a*/123*b*. The central portion 124 may be substantially flat or substantially linear over a given distance. In this regard, the central portion 124 generally may be parallel to a wearer's waist or belt while the garment is worn. The side portions 123*a*/123*b*, however, are angled in an upward direction (e.g., toward the top edge 121 of the front belt member 120). This general shape may facilitate an ergonomic fit of the belt assembly. In use, the central portion 124 of the front belt member 120 may be disposed below the wearer's waist in a manner such that it does not become pinched between the wearer's hips and abdomen when the wearer bends forward at the waist. However, simply positioning a traditional belt in this low position would tend to allow a garment to slide down the wearer's legs. Hence, the side portions 123*a*/123*b* may be angled upward to facilitate a gradual incline in the position of the belt assembly relative to the wearer's body moving from front to back around the wearer's sides. In this regard, the rear belt member 130 (FIG. 1) may be positioned above or along the wearer's waist or belt, thereby supporting the weight of the garment at the wearer's lower back region. The side portions 123*a*/123*b* may be configured at an angle ($\theta$) of at least about 5 degrees with respect to the central portion 124, such as at least about 10 degrees, and not greater the about 60 degrees, such as not greater than about 45 degrees.

The general shape of the belt assembly as described above may also facilitate improved weight distribution. In the context of a farrier's apron, a significant amount of weight may be exerted on the garment by a horse's leg during use. An embodiment of a belt assembly of the present disclosure generally tracks the shape of a human pelvis. That is to say, higher in the rear and angled around the sides down toward the lower front. This shape of a belt assembly allows the wearer to bear a large portion of the weight on their pelvis and/or other bone structures, preventing or reducing fatigue. In contrast, prior art garments distribute a substantial amount of weight into the muscles and other soft tissue of the wearer, causing pain and injury.

Also shown in FIG. 3, the front belt member 120 may further comprise an extension at one or both ends of the front belt member 120 which forms a tensioning strap (e.g., tensioning strap 125*a*). The tensioning strap 125*a* may have one end which is permanently secured to (e.g., sewn onto or into) the front belt member 120 and a free end (not illustrated in FIG. 3) which is removably attachable to the front belt member 120. In this regard, the free end of the tensioning strap 125*a* may be passed through a belt link (not illustrated in FIG. 3) disposed between the front belt member 120 and the rear belt member and bent back forward (i.e., toward the wearer's front side) from the belt link and secured to the front belt member 120 with a hook and loop fastener 126*a* disposed on side portion 123*a*. Notably, the hook and loop fastener 126*a* may be substituted with any appropriate device or material which facilitates manually attaching and removing the tensioning strap 125*a* from the front belt member 120. For example, a series of snap fasteners may be used. Alternatively, a pin or peg may be disposed upon the tensioning strap 125*a* or the front belt member 120 and a corresponding series of holes may be disposed upon the other of the tensioning strap 125*a* or the belt member 120. As another example, a strap adjustment slider may be attached to the front belt member 120 and the tensioning strap 125*a* may serpentine there through. The rear belt member may be rigidly attached to the belt link (i.e., inelastic such that the belt assembly does not stretch when the tensioning strap 125*a* is secured) or may be attached to the belt link with at least one elastic member as described above, thereby providing a degree of elasticity to the belt assembly to provide a wide range of selectable sizes (i.e., circumferences) while remaining comfortable to the wearer.

In any regard, the tensioning strap 125*a* may be configured such that a wearer may grab the free end of the tensioning strap 125*a* and pull on it to tighten (i.e., reduce the circumference of) the belt assembly around the wearer's waist. This functionality may be provided by attaching both the rear belt member and the front belt member 120 to the belt link in such a manner that moving the free end of the tensioning strap 125*a* forward pulls on the belt link which in turn pulls on the rear belt member. This movement may reduce the circumference of the belt assembly (i.e., the circumference of the aperture formed by the belt assembly in which the wearer's waist is disposed). Similarly, moving the free end of the tensioning strap 125*a* rearward may increase the circumference of the belt assembly or reduce the tension in the belt assembly. At the selected tension, the wearer may secure the free end of the tensioning strap 125*a* to the front belt member 120 or another portion of the garment such that the free end is secured in manner which retains the selected tension. If desired, the wearer may adjust the tension or circumference by releasing the free end of the tensioning strap 125*a* and reattaching it to another location on the front belt member 120 (e.g., a different part of the hook and loop fastener, a different corresponding hole, etc.).

A single tensioning strap, elastic member, and belt link may be provided such that the wearer adjusts the fit by adjusting one side of the belt assembly. Alternatively, a plurality of each of these features may be provided. For example, as illustrated in FIGS. 1-5, two of each of these features may be included such that the belt assembly 110 comprises a right and a left tensioning strap 125*a*/125*b*, right and left belt links 132*a*/132*b* (e.g., one on each of the wearer's hips), and right and left elastic members 131*a*/131*b*. Such a design may provide a greater degree of flexibility and comfort.

It is also contemplated that similar tensioning straps may be additionally or alternatively incorporated into the rear belt member. In this regard, the tensioning straps of the rear belt member would provide similar functionality to those previously described in reference to the front belt member, but may be removably attachable to a location along the rear belt member.

Figure 4:
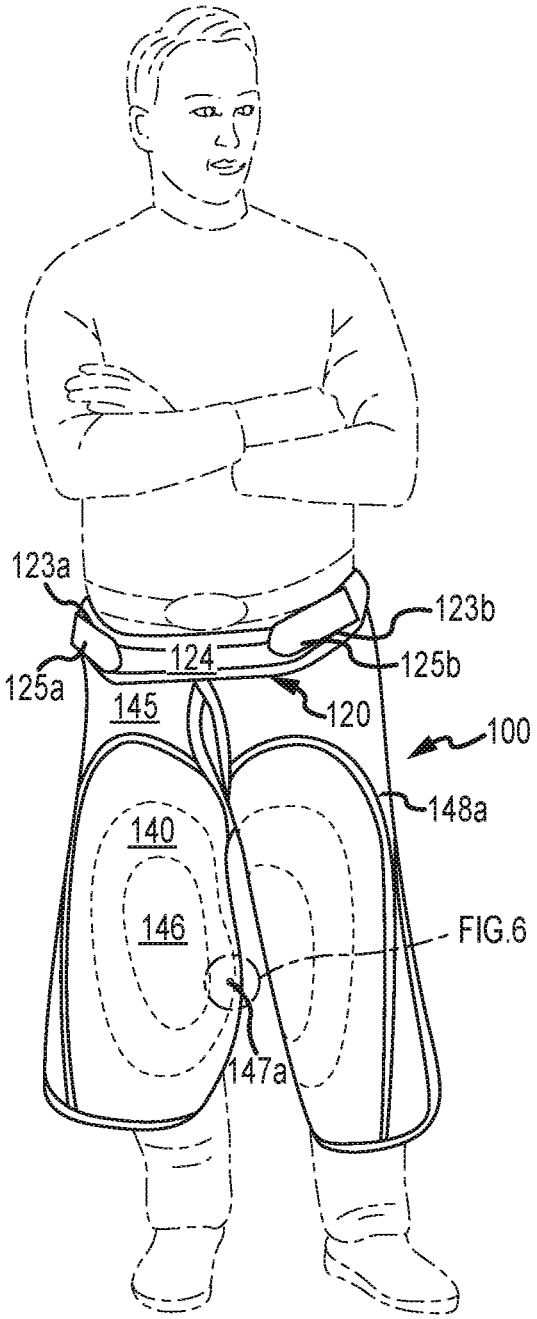
FIG. 4 illustrates a front view of a wearer donning a farrier's apron according to an embodiment of the present disclosure.

Turning to FIGS. 4 and 5, a front view and a rear view, respectively, of a person wearing a garment 100 according to an embodiment of the present disclosure is shown. The belt assembly 110 is positioned around the wearer's waist with the front belt member 120 on the front side of the wearer and the rear belt member 130 on the back side of the wearer. The central portion 124 of the front belt member 120 may be disposed at or below the wearer's waistline while the rear belt member 130 may be disposed at or above the wearer's waistline (e.g., resting on the lower back). This positioning may be facilitated by the upward angled side portions 123*a*/123*b*. The interaction between the tensioning straps 125*a*/125*b*, the belt links (e.g., belt link 132*b*), the elastic members (e.g. elastic member 131*b*), and the rear belt member 130 facilitates a selected tension or circumference which retains the garment 100 in the position shown. The leg straps (e.g., let strap 163*a*) are positioned behind the wearer's legs. By selecting the proper length of leg straps either by design or by adjusting the length with a slidable adjuster, for example, the leg straps secure the first leg strap links (e.g., first leg strap link 161*a*) in a position nearer the second leg strap links (e.g., second leg strap link 162*a*) than shown in FIG. 1. In this regard, the first leg strap links are passed between the wearer's legs as the wearer puts on the garment 100. The second leg strap links are positioned on the outside or rear of the wearer's legs. In this manner, the leg straps retain the leg members in a curved position in which they wrap around the front and sides of the wearer's legs.

Figure 6:
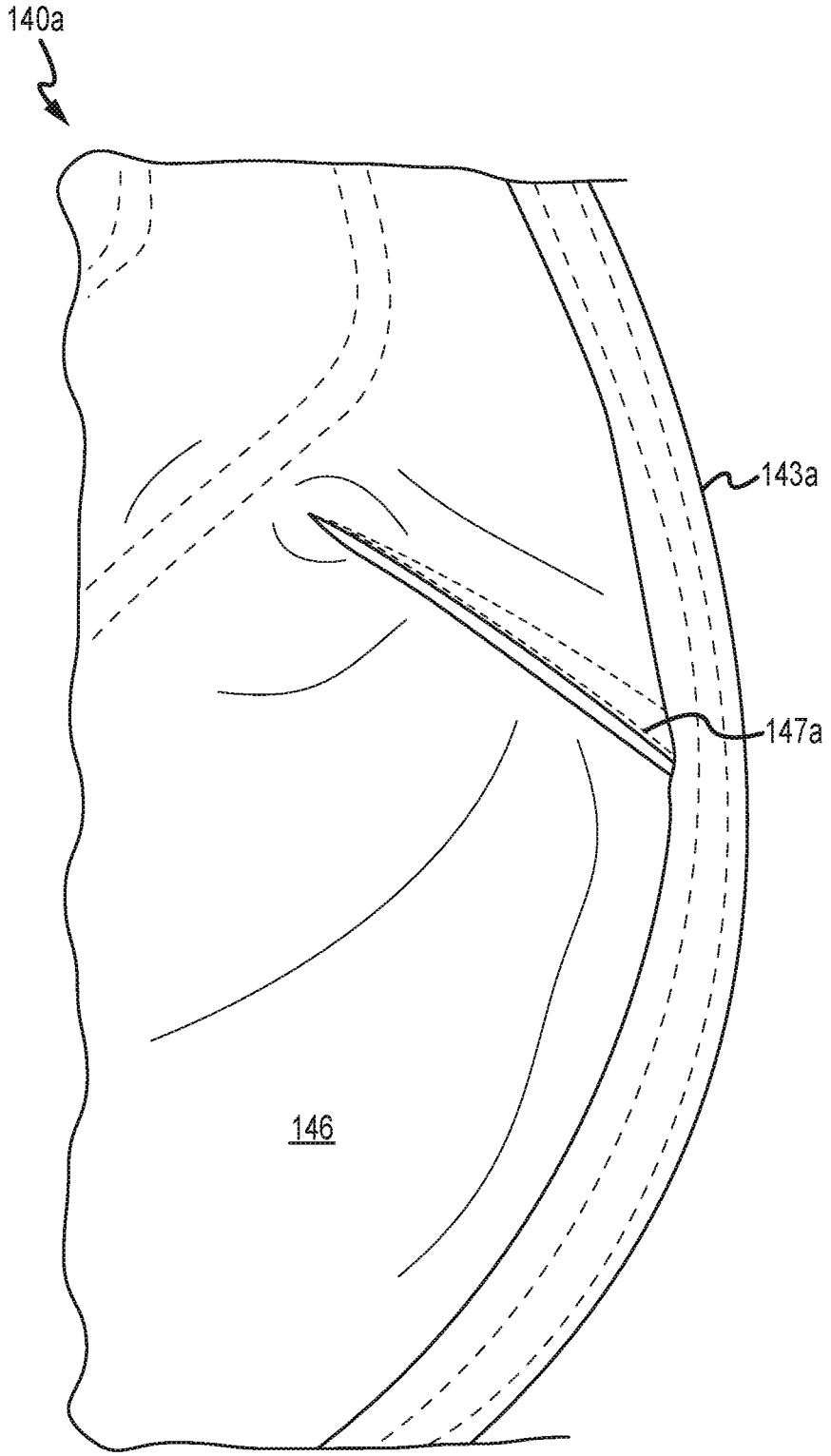
FIG. 6 provides a close-up view of a dart as may be used in an embodiment of a farrier's apron.

FIG. 6 illustrates a close-up view of a dart 147*a* sewn into the leg member 140*a* along the inner edge 143*a* (FIG. 4). A dart in the context of this disclosure refers to a feature formed in a material of the garment. A dart may be similar to a pleat, but is generally characterized by a deeper fold (e.g., overlap or removed segment) in the material. In this regard, a dart often forms a distinct point or peak (e.g., contour) with a generally conical shape surrounding the peak. However, it should be appreciated that a dart and a pleat may refer to the same or a similar feature or structure and those terms may be interchangeable.

Alternatively, or in addition to the dart 147*a* shown in FIG. 6, a dart or darts may be sewn into a distal edge or outer edge of a leg member. A dart may be constructed by cutting and removing a triangular sliver of material and then overlapping or aligning the newly formed edges, e.g., to create a conical shape. Alternatively, the material may simply be folded, rather than cut, in a manner such that a greater amount of material is overlapped at the edge (inner edge 143*a* in the illustrated example) than at the tip or end of the dart. After cutting or folding the material, the dart 147*a* may be permanently secured to retain a conical shape by sewing, gluing, stapling, or otherwise fixing the portions of the material defining the dart 147*a*. The dart 147*a* may be formed in a base material, an overlay material, or both. In the illustrated example, the dart 147*a* is formed in both the base material (not shown in FIG. 6) and the overlay material 146. Regardless of where a dart is formed, it serves to retain a curved shape in the leg member, which improves conformance to the wearer's body.

Figure 7:
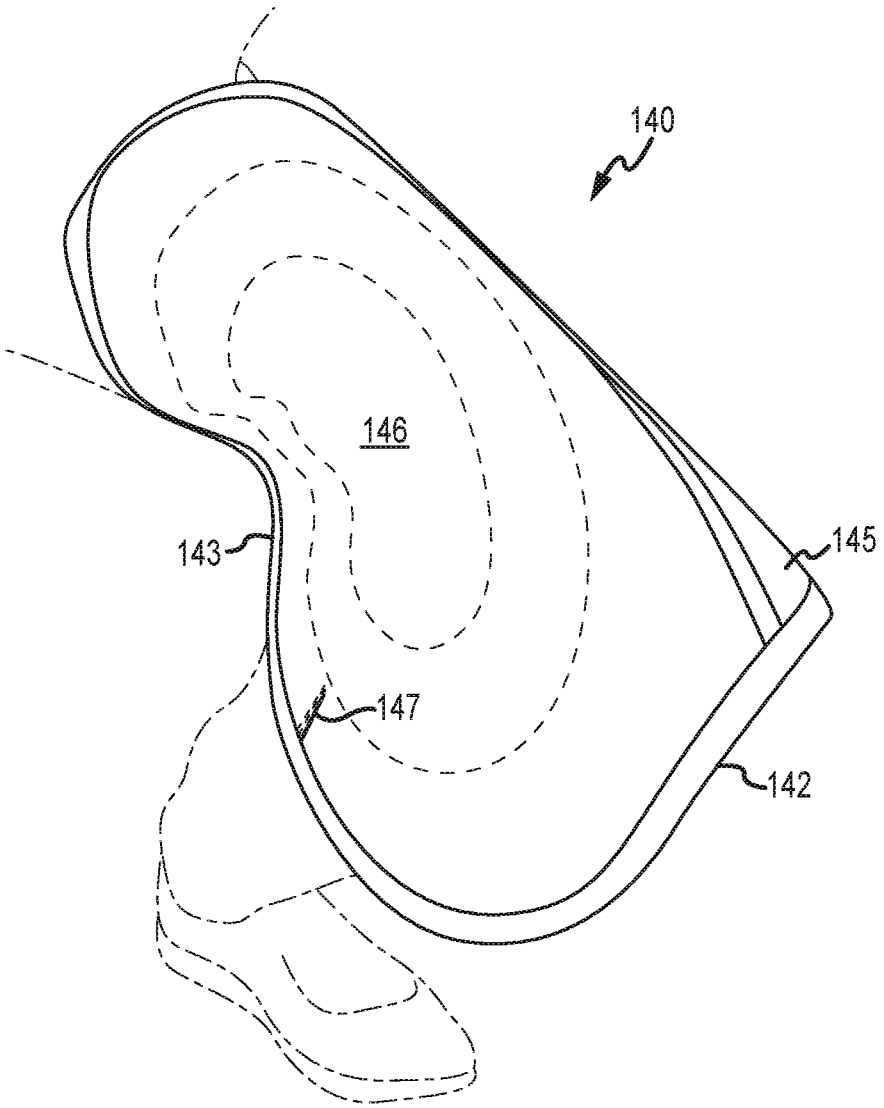
FIG. 7 illustrates an embodiment of a leg member including a dart.

As shown in FIG. 7, in one embodiment the dart 147*a* is disposed along the inner edge 143*a* below the wearer's knee, e.g., toward the distal end of the leg member 140*a*. In this regard, the dart 147*a* aids in retaining the inner edge 143*a* of the leg member 140*a* near the wearer's shin or calf muscle when the wearer kneels or squats. Without a dart 147*a* at or near that part of the leg member 140*a*, the leg member 140*a* may flare outward away from the knee and interfere with the wearer's activity, for example, shoeing a horse. Such flaring may also expose a wearer's calf and shin region to injury. A larger dart (e.g., longer length or deeper overlap of material) may help increase the effectiveness of the dart in retaining the leg member near the wearer's leg. However, a dart which is too large may decrease comfort or cause interference when the user is standing due to the exaggerated depth of the conical formation. Therefore, a dart may preferably be at least about 1 inch long and less than about 18 inches long. Similarly, a dart may preferably have an overlap (or removed section) at the widest part of at least about 0.1 inch and less than about 18 inches.

As noted above, the belt assembly of the present disclosure may be implemented independent of the other features disclosed herein. For example, a tool belt may be constructed in such a manner as to incorporate an embodiment of a belt assembly. In one instance, such a tool belt may comprise a front belt member and a rear belt member, each connected on opposite ends by at least two belt links. Additionally, pockets, pouches, rings, and other appurtenances may be attached to the belt assembly.

The present disclosure is also directed to a method for the manufacture of a garment having any or all of the features, aspects, and embodiments described herein. Broadly speaking, the method may include cutting the individual components of a garment from one or more material sheets, assembling the individual components into the desired arrangement, and applying an adhesive and/or sewing along the seams to secure the components to one another. The material sheets may be a nylon-based material, Cordura®, leather, cotton, Kevlar®, canvas, or any other suitable material.

While various embodiments and aspects have been described in detail, it is apparent that modifications and adaptations of those embodiments and aspects will occur to those skilled in the art. However, is to be expressly understood that such modifications and adaptations are within the spirit and scope of the present disclosure. Moreover, the embodiments and aspects described herein are not mutually exclusive. Each embodiment and aspect may combined with any number of others. The words "and" and "or" as used throughout this disclosure may be interpreted to mean "and/or."

What is claimed is:

1. A garment configured to protect a leg of a user wearing the garment, comprising:

a belt assembly comprising:

a front belt member comprising a top edge, a bottom edge, a first side portion, a second side portion, and a central portion disposed between the first and second side portions, wherein the first and second side portions are each disposed at an upward angle with respect to the central portion in a direction of the top edge, a rear belt member, and a first belt link operable to pivotally attach the front belt member to the rear belt member;

at least a first leg member extending from the bottom edge of the front belt member and bounded by the front belt member at a proximal edge of the first leg member, an inner edge extending from the central portion, an outer edge extending from the first side portion, and a distal edge connecting the inner edge and outer edge at a distal end of the first leg member;

a first leg strap link disposed at the inner edge;

a second leg strap link disposed at the outer edge and nearer the proximal end than the first leg strap link; and a leg strap operable to attach to both the first and second leg strap links, wherein at least one of the first or second leg strap links is removably attachable to the first leg member via a safety release.

2. The garment of claim 1, wherein the central portion of the front belt member is substantially linear and has a length of at least 5 inches.

3. The garment of claim 2, wherein the first belt link is a loop with a width exceeding a width of either the front belt member or rear belt member at an end of the front or rear belt member that is attachable to the first belt link.

4. The garment of claim 3, wherein the front belt member and rear belt member are slidably affixable to the loop such that the rear belt member is pivotally attachable to the front belt member.

5. The garment of claim 1, wherein the first and second side portions each form an angle of at least 10 degrees with respect to the central portion.

6. The garment of claim 5, wherein at least a portion of the front belt member is integrally formed with the first leg member.

7. The garment of claim 6, wherein the belt assembly further comprises a second belt link operable to pivotally attach the front belt member to the rear belt member.

8. The garment of claim 7, further comprising at least two elastic members for securing the rear belt member to the front belt member via the first and second belt links.

9. The garment of claim 1, wherein the belt assembly further comprises a first tensioning strap extending from the first side portion that is removably attachable to the first side portion to pass through the first belt link and secure the front belt member to the first belt link.

10. The garment of claim 9, wherein the first tensioning strap is removably attachable to the first side portion via a hook and loop fastener secured to the first side portion and a corresponding hook and loop fastener secured to the first tensioning strap.

11. The garment of claim 10, further comprising a second tensioning strap extending from the second side portion that is removably attachable to the second side portion to pass through the second belt link and secure the front belt member to the second belt link, wherein the second tensioning strap is removably attachable to the second side portion via a hook and loop fastener secured to the second side portion and corresponding hook and loop fastener secured to the second tensioning strap.

12. The garment of claim 1, wherein the safety release comprises a snap fastener.

13. The garment of claim 1, wherein the first leg member is comprised of nylon.

14. The garment of claim 13, wherein the first leg member further comprises a leather overlay disposed on a front side of the garment.

15. The garment of claim 14, wherein the leather overlay covers at least 50% of a front side of the first leg member.

16. The garment of claim 11, further comprising a second leg member extending from the bottom edge of the front belt member and bounded by the front belt member at a proximal edge of the second leg member, an inner edge of the second leg member extending from the central portion of the front belt member, an outer edge extending from the second side portion of the front belt member, and a distal edge connecting the inner edge of the second leg member and outer edge of the second leg member at a distal end of the second leg member, wherein the inner and outer edges of each of the first and second leg members are spaced apart from the other.

* * * * *